US009285712B2

(12) United States Patent
Kanno et al.

(10) Patent No.: US 9,285,712 B2
(45) Date of Patent: Mar. 15, 2016

(54) DEVELOPING DEVICE AND PROCESS CARTRIDGE FOR SUPPRESSING TONER LEAKAGE

(71) Applicant: CANON KABUSHIKI KAISHA, Tokyo (JP)

(72) Inventors: Kazuhiko Kanno, Odawara (JP); Shinjiro Toba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/022,574

(22) Filed: Sep. 10, 2013

(65) Prior Publication Data

US 2014/0072328 A1 Mar. 13, 2014

(30) Foreign Application Priority Data

Sep. 13, 2012 (JP) ..... 2012-201853

(51) Int. Cl.
*G03G 15/08* (2006.01)

(52) U.S. Cl.
CPC ..... *G03G 15/0898* (2013.01)

(58) Field of Classification Search
CPC ..... G03G 15/0898
USPC ..... 399/103, 105
See application file for complete search history.

(56) References Cited

U.S. PATENT DOCUMENTS 5,166,731 A * 11/1992 Aimoto et al. ..... 399/103
5,642,186 A * 6/1997 Michlin et al. ..... 399/107
5,655,178 A * 8/1997 Ishikawa et al. ..... 399/102
5,758,230 A * 5/1998 Nakaue et al. ..... 399/103
5,946,530 A * 8/1999 Tsuji et al. ..... 399/103
5,983,053 A * 11/1999 Mordenga et al. ..... 399/103
6,002,898 A * 12/1999 Yokomori et al. ..... 399/119
6,029,027 A * 2/2000 Yokomori et al. ..... 399/90
6,032,002 A * 2/2000 Yokomori et al. ..... 399/12
6,061,535 A * 5/2000 Yokomori et al. ..... 399/61
6,104,895 A * 8/2000 Yokomori et al. ..... 399/113
6,192,209 B1 * 2/2001 Ichikawa et al. ..... 399/105
6,256,467 B1 * 7/2001 Yokomori et al. ..... 399/119
6,314,255 B1 * 11/2001 Yokomori et al. ..... 399/119
6,345,164 B1 * 2/2002 Yokomori et al. ..... 399/119
6,381,430 B1 * 4/2002 Yokomori et al. ..... 399/119
6,498,914 B2 12/2002 Hashimoto et al.

(Continued)

FOREIGN PATENT DOCUMENTS

JP 2001-255741 A 9/2001
JP 3524114 A 5/2004
JP 2007-240563 A 9/2007

*Primary Examiner* — David Bolduc
(74) *Attorney, Agent, or Firm* — Canon USA Inc. IP Division

(57) ABSTRACT

A developing device configured to prevent a leakage of developer through a gap between a frame and a longitudinal end of a developer supply roller, includes an elastic bush member, a groove to which the bush member is attached and including an opening to allow an end of the developer supply roller to pass through a seating surface when the developer supply roller is mounted on the groove in a direction intersecting the longitudinal direction, an abutment portion for regulating movement of the bush member in the longitudinal direction, and a bearing member configured to rotatably support an end of the developer supply roller and compress, in the longitudinal direction, the bush member sandwiched between the abutment portion and the bearing member and bias the bush member against an inner wall of the groove.

16 Claims, 13 Drawing Sheets

(56) References Cited

U.S. PATENT DOCUMENTS

| | | | | |
|---|---|---|---|---|
| 6,934,488 | B2 * | 8/2005 | Jones et al. | 399/109 |
| 7,302,205 | B2 * | 11/2007 | Shintani et al. | 399/111 |
| 2001/0021318 | A1 * | 9/2001 | Hashimoto et al. | 399/103 |
| 2001/0026707 | A1 * | 10/2001 | Miyabe et al. | 399/111 |
| 2002/0172526 | A1 * | 11/2002 | Miyabe et al. | 399/104 |
| 2011/0200353 | A1 * | 8/2011 | Kubo et al. | 399/103 |
| 2013/0322920 | A1 * | 12/2013 | Maeshima et al. | 399/111 |

* cited by examiner

DEVELOPING DEVICE AND PROCESS CARTRIDGE FOR SUPPRESSING TONER LEAKAGE

BACKGROUND OF THE INVENTION

1. Field of the Invention

The present invention relates to developing devices and process cartridges to be used in electrophotographic image forming apparatuses.

2. Description of the Related Art

Conventionally, a process cartridge system is employed in an electrophotographic image forming apparatus using an electrophotographic imaging process. In the process cartridge system, an electrophotographic photosensitive member and a process unit that acts on the electrophotographic photosensitive member are integrated into a cartridge, and this cartridge is removably mounted to the apparatus body. The process cartridge system allows a user to perform maintenance work on the apparatus without calling a service technician, and thus the operability of the apparatus can greatly improve. Therefore, the process cartridge system is widely employed in electrophotographic image forming apparatuses. Alternatively, a development cartridge system is often employed particularly in multi-color electrophotographic image forming apparatuses. In the development cartridge system, for example, a developing unit of a process unit, except for an electrophotographic photosensitive member, is integrated into a cartridge, and this cartridge is removably mounted on the apparatus body. Such a system yields similar effects to those of the process cartridge system.

Such a process cartridge or a developing device to be used in an electrophotographic image forming apparatus has a configuration in which an elastic blade serving as a regulating member formed of metal, rubber, and the like abuts against a developing roller. Then, toner is made to pass through a gap in an abutment portion of the elastic blade against the developing roller to regulate the thickness of a toner layer, and thus a thin layer of toner is formed on the developing roller. In addition, friction in the abutment portion gives sufficient friction charges to the toner. If nonmagnetic toner is regulated by the elastic blade, a toner supply roller for supplying the toner onto the developing roller is provided along the axial direction of the developing roller. In such a developing roller and a toner supply roller, various techniques are implemented to suppress toner leakage from the developing device along the axial ends of the developing roller and the toner supply roller. For example, an outer peripheral surface of the developing roller is made to abut against end seals affixed respectively to both side surfaces, in the axial direction of the developing roller, of a development frame member, and thus toner leakage along the two ends of the developing roller is suppressed. Meanwhile, a rotational shaft of the toner supply roller extends externally from the development frame member through a center hole formed in a bush member that is fitted in a notch portion formed in a side surface of the development frame member. Then, the toner supply roller is fitted in a bearing hole provided in a bearing member that rotatably supports the developing roller and the toner supply roller.

Japanese Patent No. 3,524,114 discusses a configuration for suppressing toner leakage from both ends of a toner supply roller by disposing toner supply roller sealing members and bush sealing members. In this configuration, each toner supply roller sealing member is disposed on a location of a bearing member inside a bearing hole in the axial direction of the toner supply roller and facing a side surface of the development frame member, and each bush sealing member is disposed in the notch portion formed in the side surface in parallel to the bush member.

Japanese Patent Application Laid-Open No. 2001-255741 discusses a configuration for suppressing toner leakage from both ends of a toner supply roller by forming bush members to be fitted into notch portions formed in side surfaces of a development frame member by rubber or a resin material. In this configuration, a lip is integrated into an inner periphery of the center hole of the bush member, and the lip is slid on the shaft of the toner supply roller. Thus, the toner leakage from both ends of the toner supply roller is suppressed.

There is an increasing demand for a sealing configuration that can suppresses toner leakage more reliably and that is inexpensive and easy to assemble as a sealing configuration to suppress toner leakage from an end of the developing roller or a shaft portion of the toner supply roller in the process cartridge and the developing device described above.

SUMMARY OF THE INVENTION

The present invention is directed to a developing device and a process cartridge that include a sealing configuration that can suppresses toner leakage more reliably and that is simple and easy to assemble.

According to an aspect of the present invention, a developing device to be used in an image forming apparatus, includes a frame member, a developing roller configured to develop a latent image formed on an image bearing member using developer, a developer supply roller configured to supply the developer to the developing roller, an end sealing member mounted on a seating surface provided on the frame member, and is configured to prevent a leakage of the developer through a gap between the frame member and an end of the developing roller in a longitudinal direction thereof, a bush member having elasticity, the bush member being configured to prevent a leakage of the developer from a gap between the frame member and an end of the developer supply roller in a longitudinal direction thereof, a first groove configured to have the bush member mounted thereon, a first opening to allow an end of the developer supply roller to pass therethrough when the developer supply roller is mounted on the first groove in a direction intersecting the longitudinal direction of the developer supply roller, an abutment portion configured to regulate movement of the bush member in the longitudinal direction, and a bearing member configured to rotatably support the end of the developer supply roller, to compress the bush member in the longitudinal direction, by sandwiching the bush member between the abutment portion and the bearing member to bias the bush member against an inner wall surface of the first groove.

According to another aspect of the present invention, A developing device to be used in an image forming apparatus, includes a frame member, a developing roller configured to develop a latent image formed on an image bearing member using developer, a developer supply roller configured to supply the developer to the developing roller, an end sealing member mounted on a seating surface provided on the frame member, and is configured to prevent a leakage of the developer through a gap between the frame member and an end of the developing roller in a longitudinal direction thereof, a bush member configured to prevent a leakage of the developer through a gap between the frame member and an end of the developer supply roller in a longitudinal direction thereof, wherein bush member has a foamable property, and an outer peripheral surface of the bush member has a circular cross-sectional shape, a first groove on which the bush member is mounted, configured to have a first opening and engagement regions, the first opening being opened to allow an end of the developer supply roller to pass through the seating surface when the developer supply roller is mounted on the first groove in a direction intersecting the longitudinal direction of the developer supply roller, the engagement regions being arranged to approach each other toward the first opening and being configured to regulate movement of the bush member in the direction intersecting the longitudinal direction.

According to yet another aspect of the present invention, A process cartridge that can be attached to an image forming apparatus, includes an image bearing member, a frame member, a developing roller configured to develop a latent image formed on the image bearing member using developer, a developer supply roller configured to supply the developer to the developing roller, an end sealing member mounted on a seating surface provided on the frame member, and is configured to prevent a leakage of the developer through a gap between the frame member and an end of the developing roller in a longitudinal direction thereof, a bush member having elasticity, the bush member being configured to prevent a leakage of the developer from a gap between the frame member and an end of the developer supply roller in a longitudinal direction thereof, a first groove configured to have the bush member mounted thereon, a first opening to allow an end of the developer supply roller to pass therethrough when the developer supply roller is mounted on the first groove in a direction intersecting the longitudinal direction of the developer supply roller, an abutment portion configured to regulate movement of the bush member in the longitudinal direction, and a bearing member configured to rotatably support the end of the developer supply roller, to compress the bush member in the longitudinal direction, by sandwiching the bush member between the abutment portion and the bearing member to bias the bush member against an inner wall surface of the first groove According to still another aspect of the present invention, a process cartridge that can be attached to an image forming apparatus, includes an image bearing member, a frame member, a developing roller configured to develop a latent image formed on an image bearing member using developer, a developer supply roller configured to supply the developer to the developing roller, an end sealing member mounted on a seating surface provided on the frame member, and is configured to prevent a leakage of the developer through a gap between the frame member and an end of the developing roller in a longitudinal direction thereof, a bush member configured to prevent a leakage of the developer through a gap between the frame member and an end of the developer supply roller in a longitudinal direction thereof, wherein bush member has a foamable property, and an outer peripheral surface of the bush member has a circular cross-sectional shape, a first groove on which the bush member is mounted, configured to have a first opening and engagement regions, the first opening being opened to allow an end of the developer supply roller to pass through the seating surface when the developer supply roller is mounted on the first groove in a direction intersecting the longitudinal direction of the developer supply roller, the engagement regions being arranged to approach each other toward the first opening and being configured to regulate movement of the bush member in the direction intersecting the longitudinal direction

DESCRIPTION OF THE EMBODIMENTS

Hereinbelow, exemplary embodiments for implementing the present invention will be described in detail with reference to the drawings. The size, the material, and the shape of each component and a relative disposition thereof described in the exemplary embodiments are to be modified appropriately in accordance with configurations of devices and various conditions to which the exemplary embodiments are applied. In other words, the exemplary embodiments described hereinbelow are not in any way intended to limit the scope of the present invention.

The present invention relate to developing devices to be used in electrophotographic image forming apparatuses such as an electrophotographic copying machine and printer. Here, the electrophotographic image forming apparatus is configured to form an image on a recording medium through an electrophotographic system. Examples of such an electrophotographic image forming apparatus include an electrophotographic copying machine, an electrophotographic printer (e.g., laser beam printer and a light emitting diode (LED) printer), a facsimile machine, and a word processor. The term "developing device" refers to a device in which a developing unit to be used to develop an electrostatic latent image on an electrophotographic photosensitive member is integrally formed, and the developing device may partially constitute a process cartridge or the developing device alone can be removably mounted on an electrophotographic image forming apparatus. A development cartridge at least includes a developer bearing member (developing roller), and this development cartridge is configured to be removable from an image forming apparatus body. A process cartridge is obtained by integrating a developing device and a photosensitive member unit that includes at least an electrophotographic photosensitive member (photosensitive drum) serving as an image bearing member and is configured to be removable from an electrophotographic image forming apparatus body.

In the following exemplary embodiments of the present invention, a full color image forming apparatus on which four process cartridges each including a developing device can be removably mounted will be described as an example of an image forming apparatus. However, the number of process cartridges to be mounted on the image forming apparatus is not limited to four, and may be set appropriately as desired. For example, a single process cartridge is mounted on an image forming apparatus that forms monochrome images.

Further, in the exemplary embodiments described below, a printer is described as an example of the image forming apparatus. However, the image forming apparatus is not limited to the printer. For example, the image forming apparatus can be a copying machine, a facsimile machine, or a multifunction peripheral in which functions of the copying machine and the facsimile machine are combined.

<Configuration of Image Forming Apparatus>

Figure 2:
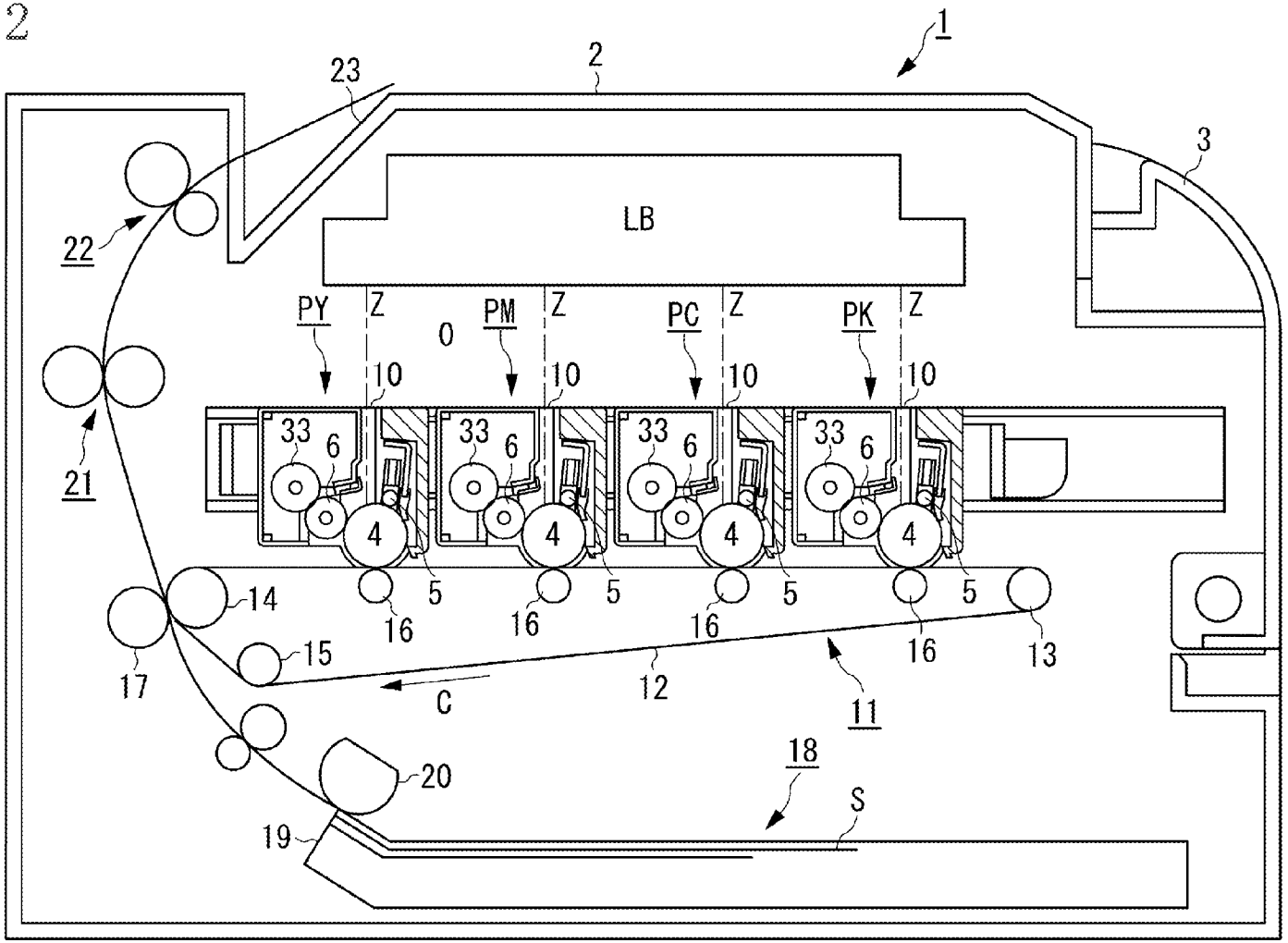
FIG. 2 is a schematic sectional view illustrating an example of an electrophotographic image forming apparatus according to the first exemplary embodiment.

FIG. 2 is a schematic sectional view of an image forming apparatus according to a first exemplary embodiment. An image forming apparatus 1 is a four full color laser printer that employs an electrophotographic process and forms a color image on a recording medium S. The image forming apparatus 1 employs a so-called process cartridge system, and process cartridges (hereinafter, cartridges) are removably mounted on an apparatus body 2 to form a color image on the recording medium S.

Here, a side of the image forming apparatus 1 at which an apparatus opening/closing door 3 is provided is referred to as a front side, and the opposite side thereto is referred to as a rear side. In addition, viewed from the front side in FIG. 2, the right side of the image forming apparatus 1 is referred to as a drive side, and a left side thereof is referred to as a non-drive side.

Four cartridges P (PY, PM, PC, PK) including a first cartridge PY, a second cartridge PM, a third cartridge PC, and a fourth cartridge PK are arranged in a horizontal direction in the apparatus body 2. The first to fourth cartridges P (PY, PM, PC, PK) each include a similar electrophotographic process mechanism, but each has a developer (hereinafter, referred to as toner) of a different color. Rotational drive force is transmitted to the first to fourth cartridges P (PY, PM, PC, PK) from a drive output unit (not illustrated) of the apparatus body 2. In addition, a bias voltage (charging bias, developing bias, or the like) (not illustrated) is supplied to each of the first to fourth cartridges P (PY, PM, PC, PK) from the apparatus body 2.

Figure 3:
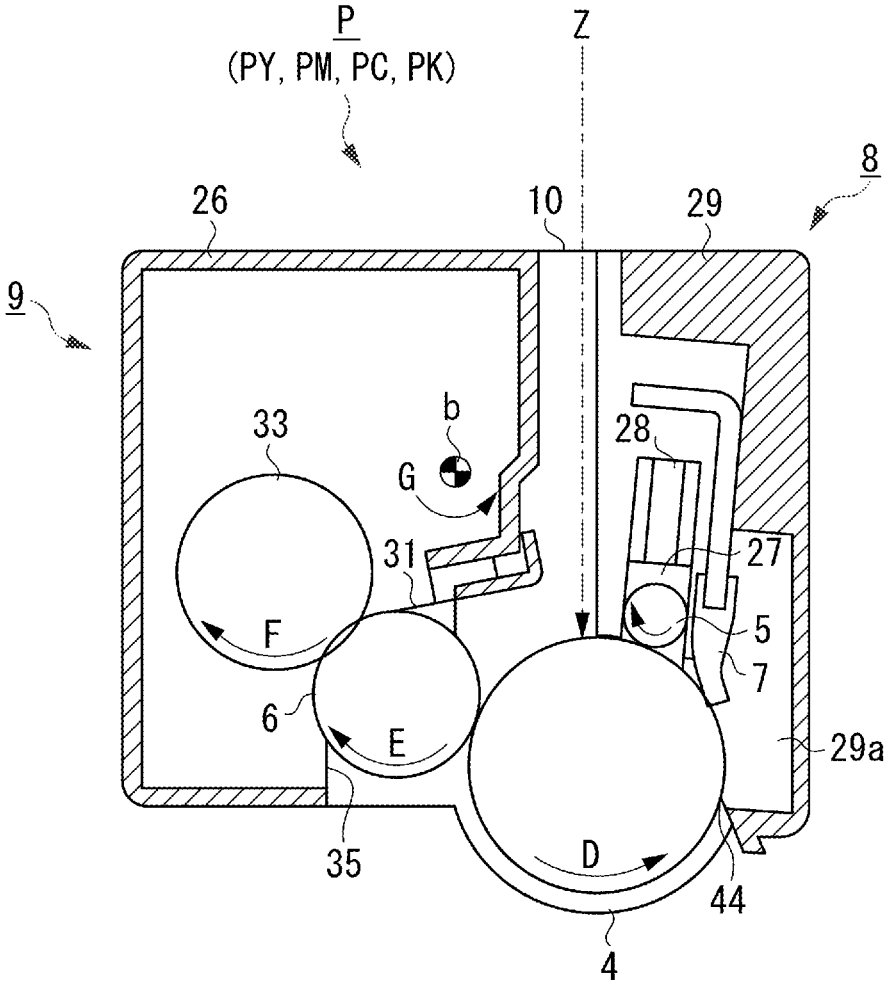
FIG. 3 is a sectional view illustrating an example of a process cartridge according to the first exemplary embodiment.

FIG. 3 is a schematic sectional view illustrating an example of the process cartridge according to the present exemplary embodiment. As illustrated in FIG. 3, the first to fourth cartridges P (PY, PM, PC, PK) each include a photosensitive drum (electrophotographic photosensitive member) 4 and a cleaning unit 8 including a charging unit and a cleaning means serving as a process unit to act on the photosensitive drum 4. The first to fourth cartridges P (PY, PM, PC, PK) each further include a developing device 9 that includes a developing unit for developing an electrostatic latent image on the photosensitive drum 4. The cleaning unit 8 and the developing device 9 are interconnected. The cleaning unit 8 includes a charging roller 5 as a charging unit and a cleaning blade 7 as a cleaning unit, and the developing device 9 includes a developing roller (developer bearing member) 6 as the developing unit. The configuration of the cartridge P will be described below in further detail.

The first cartridge PY retains yellow toner (Y) in a development frame member 26 and forms a yellow toner image on the surface of the photosensitive drum 4. The second cartridge PM retains magenta (M) toner in a development frame member 26 and forms a magenta toner image on the surface of the photosensitive drum 4. The third cartridge PC retains cyan (C) toner in a development frame member 26 and forms a cyan toner image on the surface of the photosensitive drum 4. The fourth cartridge PK retains black toner (B) in a development frame member 26 and forms a black toner image on the surface of the photosensitive drum 4.

Referring back to FIG. 2, a laser scanner unit LB serving as an exposure unit is provided above the first to fourth cartridges P (PY, PM, PC, PK). This laser scanner unit LB outputs laser beams Z in accordance with image information. Then, the laser beams Z pass through respective exposure windows 10 to scan the surfaces of the photosensitive drums 4, respectively.

An intermediate transfer belt unit 11 serving as a transfer unit is provided under the first to fourth cartridges P (PY, PM, PC, PK). This intermediate transfer belt unit 11 includes a drive roller 13, a turn roller 14, and a tension roller 15, and a flexible transfer belt 12 is stretched around these rollers. The photosensitive drums 4 of the first to fourth cartridges P (PY, PM, PC, PK) are in contact, at lower surfaces thereof, with an upper surface of the transfer belt 12. Portions where the photosensitive drums 4 are in contact with the transfer belt 12 each serve as a primary transfer portion. Primary transfer rollers 16 are provided to oppose the respective photosensitive drums 4 inside the transfer belt 12. A secondary transfer roller 17 is arranged to abut against the turn roller 14 with the transfer belt 12 provided therebetween. A portion where the transfer belt 12 contacts the secondary transfer roller 17 serves as a secondary transfer portion.

A feeding unit 18 is provided under the intermediate transfer belt unit 11. The feeding unit 18 includes a paper feed tray 19 for storing stacked recording media S therein and a paper feed roller 20. The apparatus body 2 further includes a fixing unit 21 and a discharge unit 22, which are arranged at an upper left side therein. An upper surface of the apparatus body 2 serves as a discharge tray 23. A toner image is fixed onto a recording medium S by the fixing unit 21, and the recording medium S is then discharged to the discharge tray 23.

<Image Forming Operation>

Operations for forming a full color image are as follows.

The photosensitive drums 4 of the respective first to fourth cartridges P (PY, PM, PC, PK) are rotationally driven at a predetermined speed (in a direction of an arrow D in FIG. 3, or in a counterclockwise direction in FIG. 2). Then, the transfer belt 12 is also rotationally driven along with the rotation of the photosensitive drums 4 in a forward direction (i.e., direction of an arrow C in FIG. 2) at a speed according to the rotation speed of the photosensitive drums 4.

The laser scanner unit LB is also driven. In synchronization with the driving of the laser scanner unit LB, in the cartridges P, the charging rollers 5 cause the surfaces of the respective photosensitive drums 4 to become uniformly charged to predetermined polarity and potential. The laser scanner unit LB scans the surfaces of the photosensitive drums 4 with the respective laser beams Z in accordance with image signals of corresponding colors. Thus, electrostatic latent images are formed on the surfaces of the respective photosensitive drums 4 in accordance with the image signals of corresponding colors. The resulting electrostatic latent images are developed by the developing rollers 6 that are rotationally driven at a predetermined speed (in a direction of an arrow E in FIG. 3, or in a clockwise direction in FIG. 2).

Through such electrophotographic image forming process operations, a yellow toner image corresponding to a yellow component of a full color image is formed on the photosensitive drum 4 of the first cartridge PY. Then, this toner image primary transferred onto the transfer belt 12. Similarly, a magenta toner image corresponding to a magenta component of the full color image is formed on the photosensitive drum 4 of the second cartridge PM. Then, this toner image is primary transferred onto the transfer belt 12, where the magenta toner image is superimposed on the yellow toner image that is already formed thereon. A cyan toner image corresponding to a cyan component of the full color image is formed on the photosensitive drum 4 of the third cartridge PC. Then, this toner image is primary transferred onto the transfer belt 12, where the cyan toner image is superimposed on the yellow and magenta toner images that are already formed thereon. A black toner image corresponding to a black component of the full color image is formed on the photosensitive drum 4 of the fourth cartridge PK. Then, this toner image is primary transferred onto the transfer belt 12, where the black toner image is superimposed on the yellow, magenta, and cyan toner images that are already formed thereon.

In this manner, the full color unfixed toner image composed of yellow, magenta, cyan, and black is formed on the transfer belt 12.

Meanwhile, a recording medium S is separated and fed one by one at a predetermined control timing. The recording medium S is guided into the secondary transfer portion, which is a portion where the secondary transfer roller 17 abuts against the transfer belt 12, at a predetermined control timing. Thus, the superimposed toner images of the four colors on the transfer belt 12 are transferred together onto a surface of the recording medium S while the recording medium S is conveyed through the secondary transfer portion.

<Configuration of Cartridge>

Figure 1:
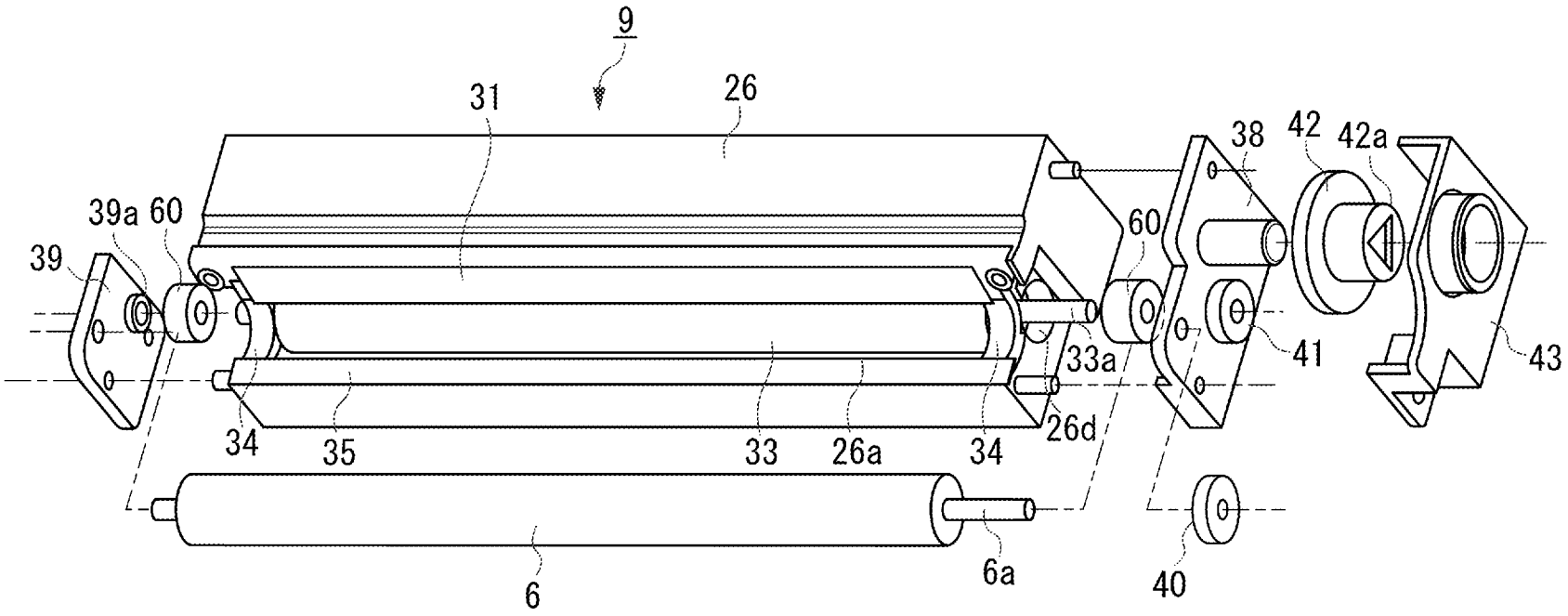
FIG. 1 is an exploded perspective view of a developing device according to a first exemplary embodiment.
Figure 4:
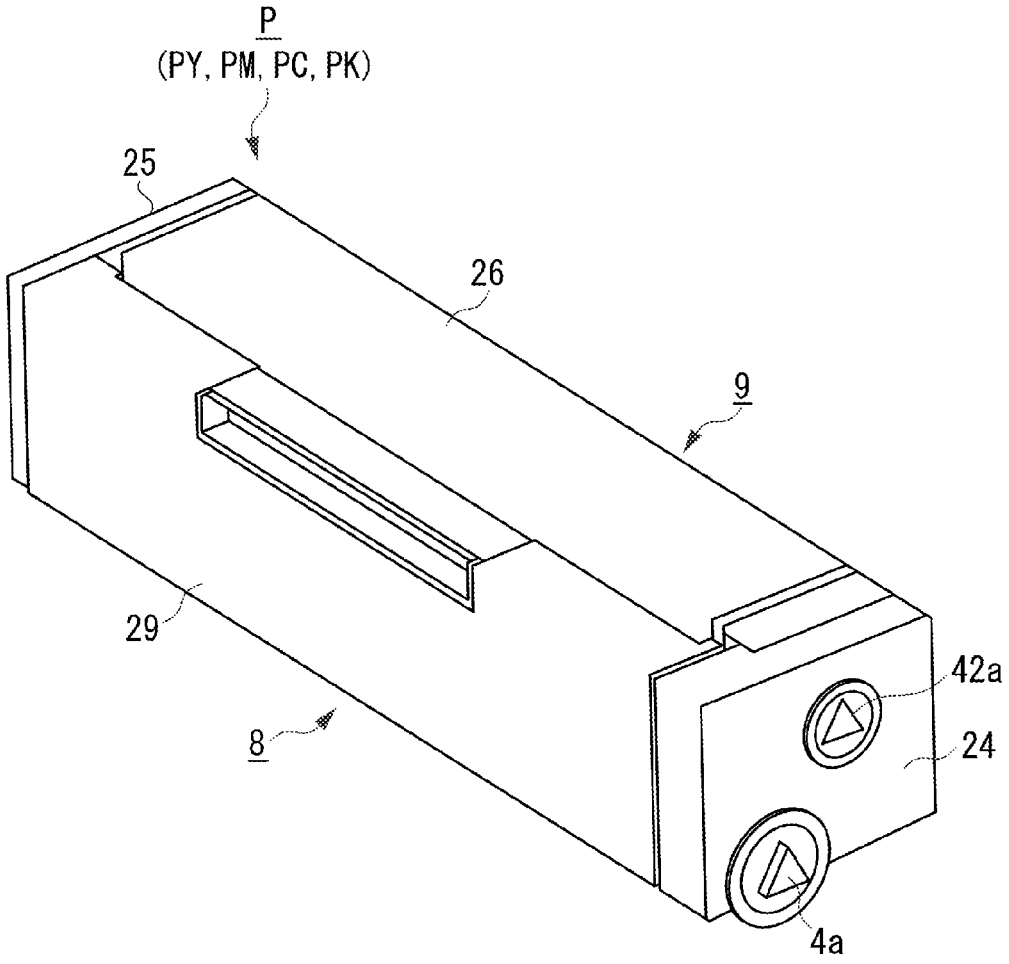
FIG. 4 is a perspective view of the process cartridge according to the first exemplary embodiment, as viewed from a drive side.

The cartridge according to the first exemplary embodiment will now be described with reference to FIGS. 1, 3, and 4. FIG. 1 is an exploded perspective view of the developing device according to the first exemplary embodiment. FIG. 4 is a perspective view of the cartridge according to the first exemplary embodiment, as viewed from the drive side.

As illustrated in FIG. 4, each of the cartridges P (PY, PM, PC, PK) has a shape that is elongated in an axial direction of a rotational shaft of the photosensitive drum 4. The cartridges P (PY, PM, PC, PK) each include the cleaning unit 8, the developing device 9, a drive side cover member 24, and a non-drive side cover member 25. Referring again to FIG. 3, the cleaning unit 8 includes the photosensitive drum 4, the charging roller 5, and a cleaning container 29 that includes the cleaning blade 7.

As illustrated in FIG. 4, the photosensitive drum 4 is rotatably supported by the drive side cover member 24 and the non-drive side cover member 25 and is rotationally driven (in the direction of the arrow D in FIG. 3) through drive force transmitted from a motor (not illustrated) of the apparatus body 2 via a drum drive coupling 4*a*. As illustrated in FIG. 3, the charging roller 5 is rotatably supported at both ends by a charging roller bearing 27 in the cleaning container 29. The charging roller 5 is in contact with the surface of the photosensitive drum 4 and is rotated along with the rotation of the photosensitive drum 4. Then, the charging roller 5, being supplied with a charging bias, causes the surface of the photosensitive drum 4 to be charged. Here, the both ends of the charging roller 5 are pressed against the surface of the photosensitive drum 4 by pressurization springs 28 to charge the surface of the photosensitive drum 4 uniformly.

The cleaning blade 7 is fixed to the cleaning container 29 and a rubber portion at a leading end thereof abuts against the photosensitive drum 4 with the tip of the rubber portion being oriented in a counter direction to the direction of rotation of the photosensitive drum 4 (i.e., direction of the arrow D in FIG. 3). The cleaning blade 7 cleans the surface of the photosensitive drum 4 by scraping residual transfer toner off the photosensitive drum 4 during image formation. The leading end of the cleaning blade 7 abuts against the surface of the photosensitive drum 4 at a predetermined contact pressure to completely scrape the residual transfer toner off the surface of the photosensitive drum 4.

The residual transfer toner that has been scraped off the surface of the photosensitive drum 4 by the cleaning blade 7 is collected, as waste toner, into a waste toner collecting unit 29*a* of the cleaning container 29. A waste toner collection sheet member 44 is fixed to the cleaning container 29 in the longitudinal direction of the photosensitive drum 4 to suppress waste toner leakage through a gap between the photosensitive drum 4 and the cleaning blade 7. In addition, cleaning blade end sealing members (not illustrated) are provided respectively at longitudinal ends of the cleaning blade 7.

<Configuration of Developing Device>

As illustrated in FIG. 1, the developing device 9 has a shape that is elongated in a direction of the rotational shaft of the developing roller 6 serving as the developing unit. The developing device 9 includes, besides the developing roller 6, the development frame member 26, a development blade 31, a toner supply roller 33, development end sealing members 34, a flexible sheet member 35, and bush members 60.

The developing roller 6 and the toner supply roller 33 are disposed in an opening 26*a* of the development frame member 26, and the axial ends of the developing roller 6 and of the toner supply roller 33 are rotatably supported by a drive side bearing 38 and a non-drive side bearing 39 that are mounted respectively to the side surfaces of the development frame member 26. Rotation of the developing roller 6 causes the toner to be carried from the interior to the exterior of the development frame member 26. A developing roller gear 40 and a supply roller gear 41 are disposed respectively at a drive-side end of a shaft 6*a* of the developing roller 6 and a drive-side end of a shaft 33*a* of the toner supply roller 33, and the developing roller gear 40 and the supply roller gear 41 mesh with a development drive input gear 42. The development drive input gear 42 includes a development drive coupling 42*a*, and the development drive coupling 42*a* engages with a drive output coupling (not illustrated) on the apparatus body 2 side. Thus, drive force from a drive motor (not illustrated) of the apparatus body 2 is transmitted to the developing roller 6 and the toner supply roller 33 and causes the developing roller 6 and the toner supply roller 33 to be rotationally driven at a predetermined speed.

The development blade 31 is formed by an elastic thin metal plate having a thickness of approximately 0.1 mm, and the free end in the lateral direction of the development blade 31 abuts against the developing roller 6 in a counter direction to the direction of rotation of the developing roller 6 (i.e., direction of the arrow E in FIG. 3). As illustrated in FIG. 1, the development end sealing members 34 are disposed at the respective ends of the opening 26*a* of the development frame member 26 to suppress toner leakage through a gap between the development blade 31 and developing roller 6, and the development frame member 26.

As illustrated in FIGS. 1 and 3, the flexible sheet member 35 is disposed at a longitudinal side surface in the opening 26*a* of the development frame member 26 that opposes the development blade 31, and the flexible sheet member 35 abuts against the developing roller 6 to suppress toner leakage through a gap between the development frame member 26 and the developing roller 6. Further, the bush members 60 disposed at the respective ends of the opening 26*a* of the development frame member 26 suppress toner leakage along the shaft 33*a* of the toner supply roller 33 at a portion of the shaft 33*a* that is exposed to the exterior of the development frame member 26 through the opening 26*a*. Sealing configurations for the developing roller 6 and the toner supply roller 33 will be described below in detail.

In the developing device 9, the developing roller 6 is continuously biased by a pressurization spring (not illustrated) in a direction in which the developing roller 6 comes into contact with the photosensitive drum 4 with an axis b illustrated in FIG. 3 serving as a swing center (i.e., direction of an arrow G in FIG. 3), and thus the developing roller 6 abuts against the photosensitive drum 4. During image forming, as the toner supply roller 33 and the developing roller 6 are driven to rotate and rub against each other, toner within the development frame member 26 is borne onto the developing roller 6. The development blade 31 regulates the thickness of a toner layer formed on the peripheral surface of the developing roller 6, and also provides electric charges to the toner through frictional charging caused by an abutment pressure with the developing roller 6. Then, the electrically charged toner on the developing roller 6 adheres onto the electrostatic latent image on the photosensitive drum 4 at a contact portion of the developing roller 6 and the photosensitive drum 4, and thus the latent image is developed.

<Sealing Configuration and Mounting Configuration of Developing Roller and Toner Supply Roller>

Figure 5A:
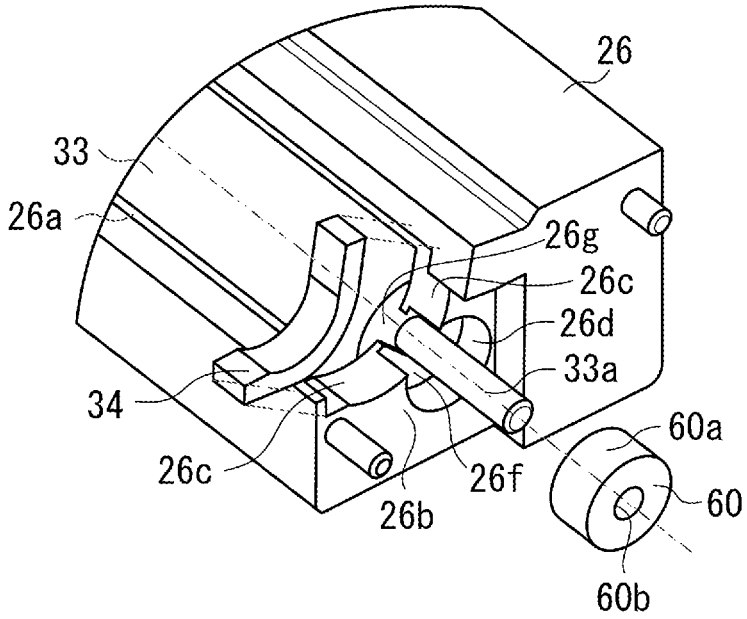
FIGS. 5A and 5B are exploded perspective views each illustrating a main section of the developing device according to the first exemplary embodiment.
Figure 5B:
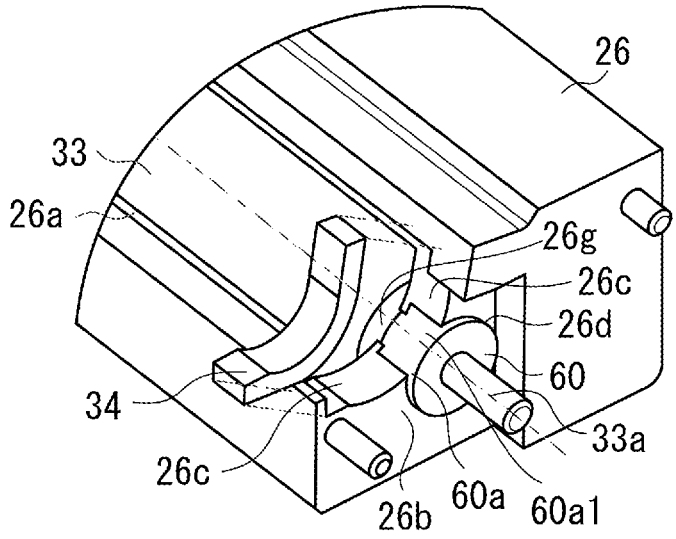
Figure 6:
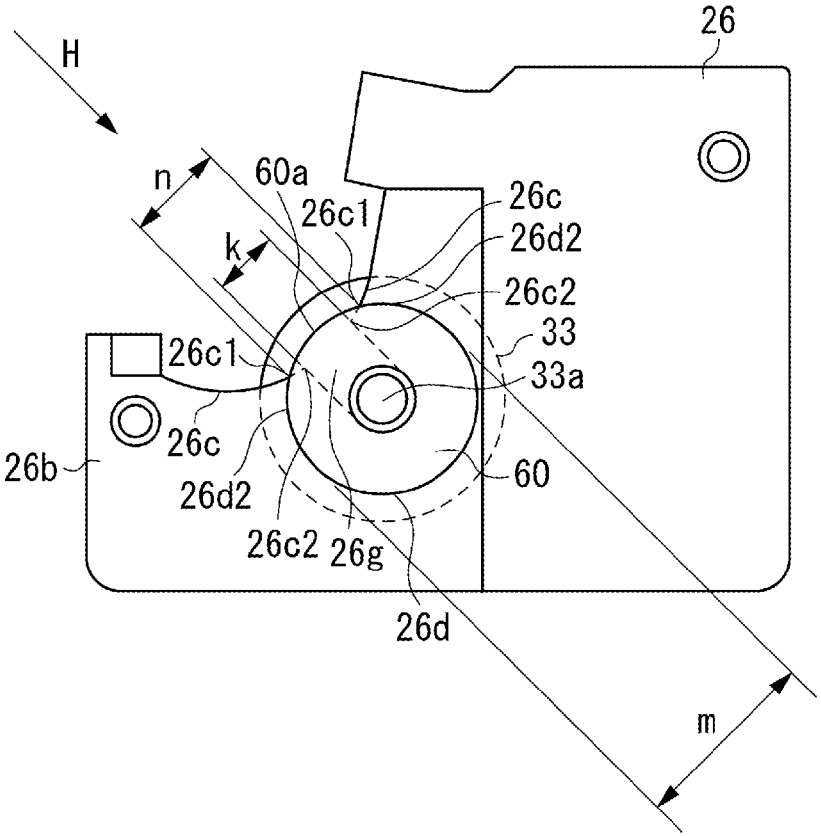
FIG. 6 is a side view illustrating the main section of the developing device according to the first exemplary embodiment.
Figure 7A:
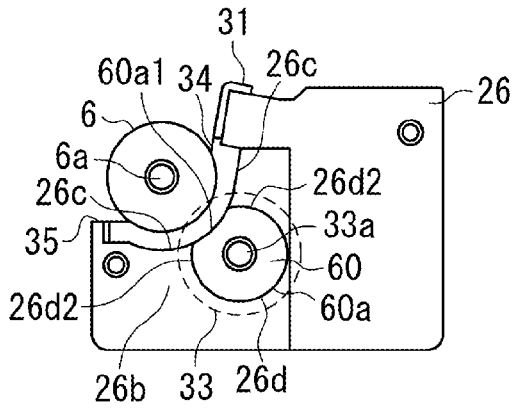
FIGS. 7A to 7C are diagrams each illustrating an assembling configuration of the developing device according to the first exemplary embodiment.
Figure 7B:
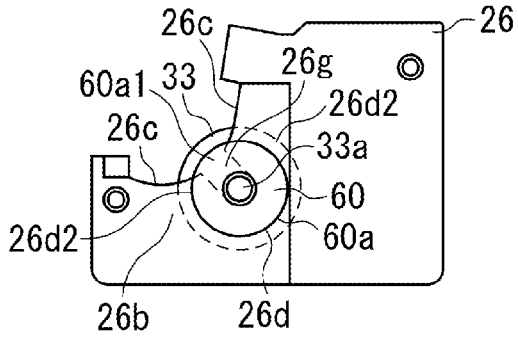
Figure 7C:
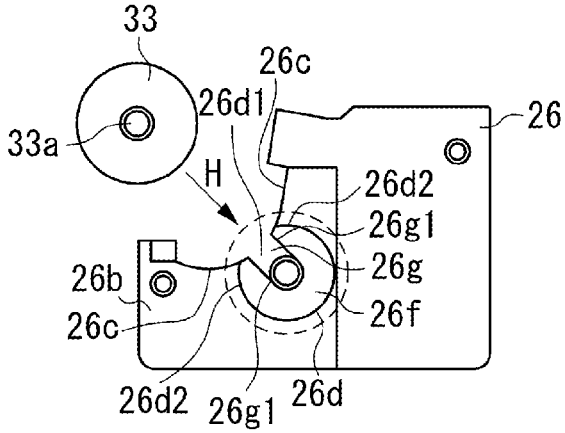
Figure 8:
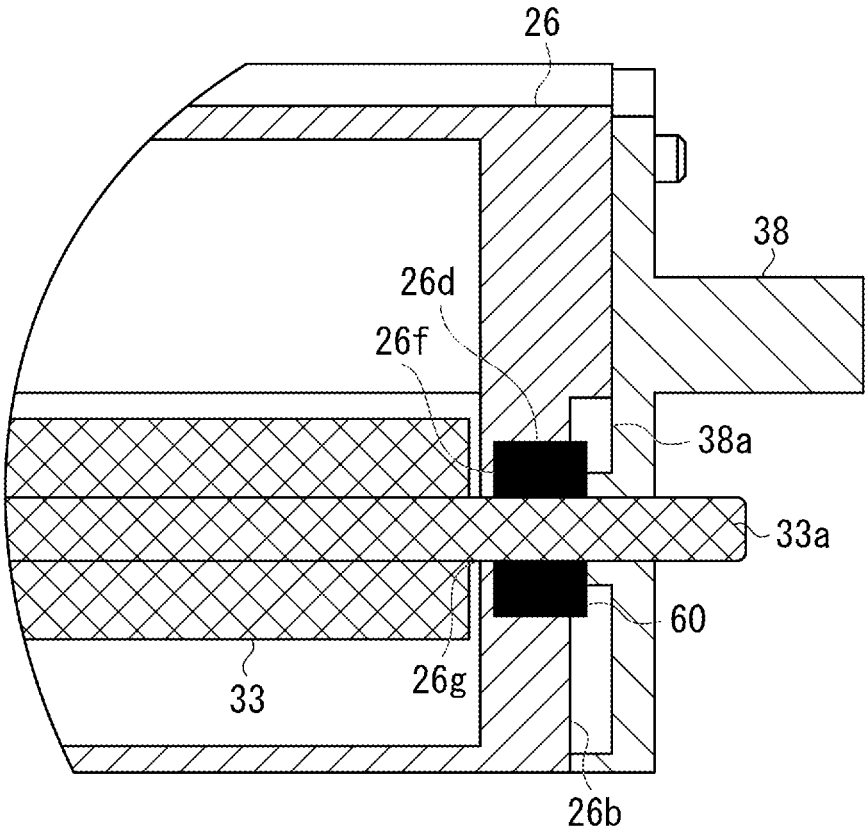
FIG. 8 is a sectional view illustrating the main section of the developing device according to the first exemplary embodiment.
Figure 9:
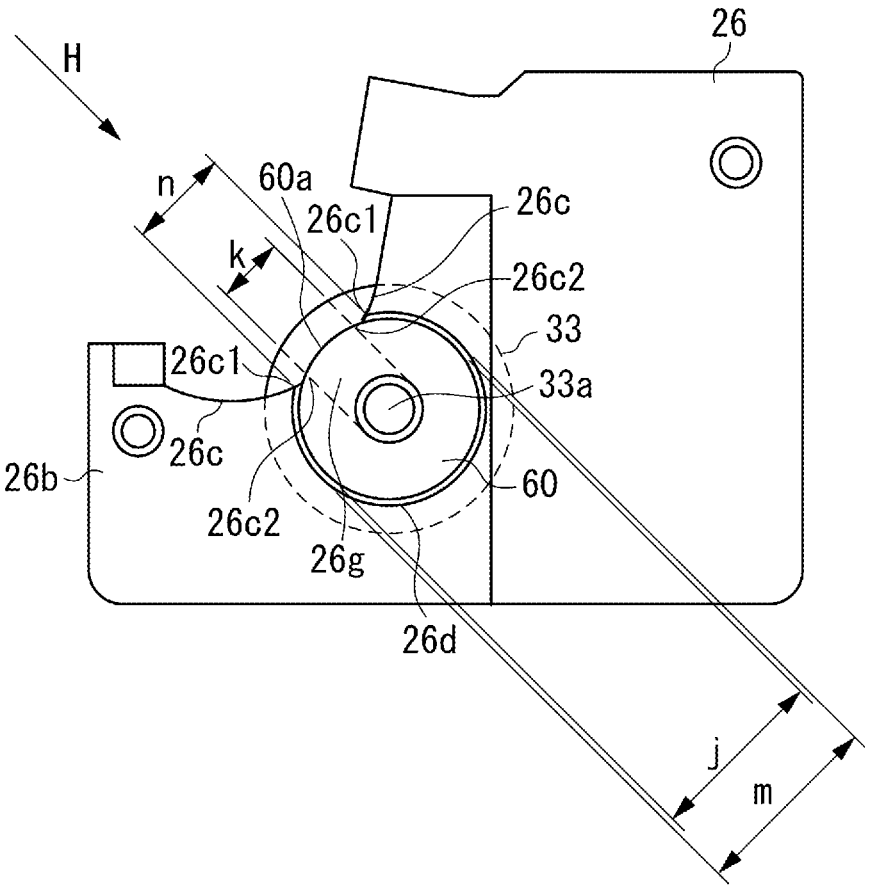
FIG. 9 is a side view illustrating the main section of the developing device according to the first exemplary embodiment.
Figure 10A:
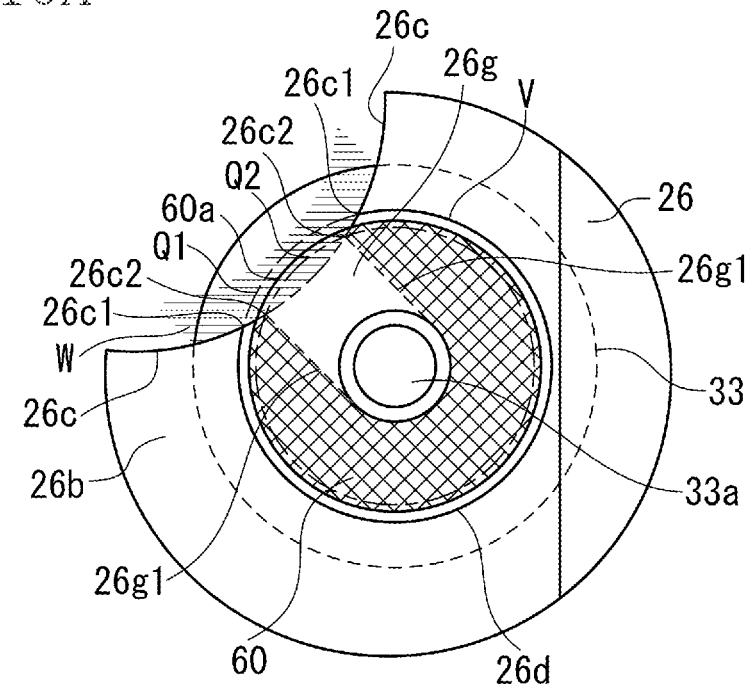
FIGS. 10A and 10B are detailed side views each illustrating the main section of the developing device according to the first exemplary embodiment.
Figure 10B:
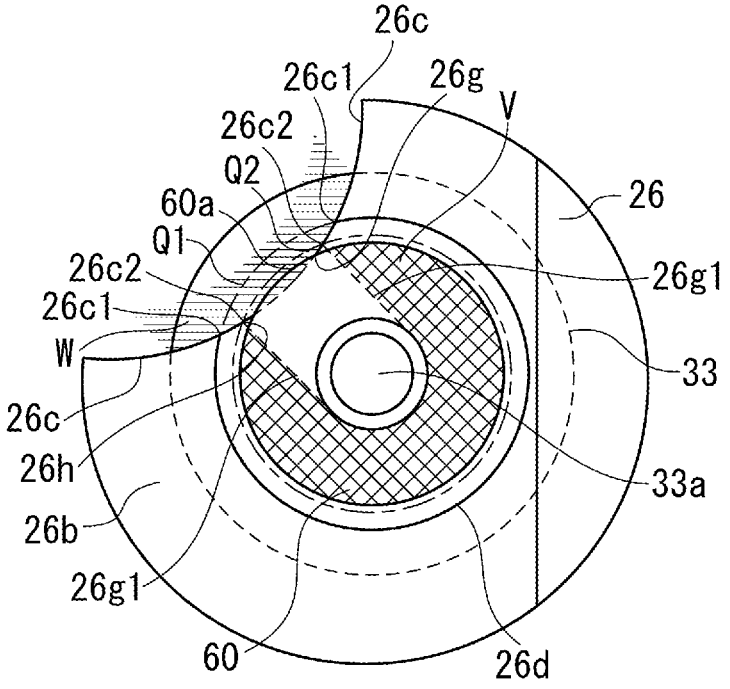

With reference to FIGS. 5A to 10B, a sealing configuration of the toner supply roller (developer supply roller) of the first exemplary embodiment will be described. FIGS. 5A and 5B are exploded perspective views each illustrating a main portion (portion around one end) of the developing device according to the present exemplary embodiment. FIG. 5A illustrates a state before the bush member is mounted, and FIG. 5B illustrates a state after the bush member is mounted. FIG. 6 is a side view illustrating the main portion (portion around the end) of the developing device according to the present exemplary embodiment. FIGS. 7A to 7C are diagrams each illustrating a mounting configuration of the developing device according to the present exemplary embodiment. FIG. 7A illustrates a state after the entire primary components are mounted, FIG. 7B illustrates a state after the bush member is mounted, and FIG. 7C illustrates a state before the toner supply roller is mounted. FIG. 8 is a sectional view illustrating the main portion (portion around the end) of the developing device according to the present exemplary embodiment. FIG. 9 is a side view illustrating the main portion (portion around the end) of the developing device according to the present exemplary embodiment. FIGS. 10A and 10B are side views each illustrating, in detail, the main portion (portion around the end) of the developing device according to the present exemplary embodiment. FIG. 10A illustrates a case where the outer diameter of the bush member satisfies a predetermined dimensional relationship, and FIG. 10B illustrates a case where the outer diameter of the bush member does not satisfy a predetermined dimensional relationship. Although only the sealing configuration and the mounting configuration of the developing roller and the toner supply roller on the drive side are described below, the configurations at the non-drive side may be similar thereto.

As described above, the developing roller 6 and the toner supply roller 33 are disposed in the opening 26*a* of the development frame member 26 (see FIG. 1). As illustrated in FIG. 5A, a wall portion 26*b* is formed at a drive-side end, in an axial direction of the developing roller 6, of the opening 26*a* of the development frame member 26. An affixing seating surface 26*c* for affixing the development end sealing member 34 thereto and an engagement groove 26*d* for fixing the bush member 60 thereinto are formed in the wall portion 26*b*. The engagement groove 26*d* is formed in a substantially cylindrical shape and arranged coaxially with the toner supply roller 33. The engagement groove 26*d* includes an opening 26*d*1 (see FIG. 7C) that is opened at the affixing seating surface 26*c* for the development end sealing member 34. The engagement groove 26*d* is formed so as to become gradually narrower toward the affixing seating surface 26*c* (i.e., toward the opening 26*d*1).

Specifically, as illustrated in FIG. 6, the width of the engagement groove 26*d* as viewed in a toner supply roller 33 mounting direction H (i.e., the width along a direction perpendicular to the direction H) takes on a maximum width m in a region that contains the center of the toner supply roller 33 in a state in which the toner supply roller 33 is mounted in the engagement groove 26*d*. Then, the width of the engagement groove 26*d* gradually decreases from the maximum width m from a downstream side toward an upstream side in the toner supply roller mounting direction H and takes on a minimum width n at an opening defined by ridgelines 26*c*1 intersecting the affixing seating surface 26*c*.

Referring back to FIG. 5A, an inner wall surface (abutment surface) 26*f* is formed on the engagement groove 26*d* at an inner side thereof in the axial direction of the developing roller 6, and the bush member 60 abuts against the inner wall surface 26*f* in the axial direction of the developing roller 6 when the bush member 60 is mounted on the development frame member 26. Further, a U-shaped groove (second engagement groove) 26*g* is formed in the inner wall portion in the axial direction on which the inner wall surface 26*f* is formed, and the U-shaped groove 26*g* is opened toward the affixing seating surface 26*c* for the development end sealing member 34. With reference to FIG. 6, the width k of an opening defined by ridgelines 26*c*2 formed by the affixing seating surface 26*c* for the development end sealing member 34 and the U-shaped groove 26*g* (i.e., the distance between side surfaces 26*g*1 (see FIG. 7C)) is set to be greater than the diameter of the shaft 33*a* of the toner supply roller 33 so that the shaft 33*a* can be inserted thereinto.

The bush member 60 is formed of an elastic material such as a foamable material (e.g., foamed urethane) and is cylindrical in shape as illustrated in FIG. 5A. The bush member 60 includes an outer peripheral surface 60*a*, which is to engage with the engagement groove 26*d*, and a hole portion 60*b*, into which the shaft 33*a* of the toner supply roller 33 is to be inserted. When the bush member 60 is fitted in the engagement groove 26*d*, as illustrated in FIG. 5B, part of the outer peripheral surface 60*a* (i.e., exposure surface 60*a*1) is exposed from the affixing seating surface 26*c* for the development end sealing member 34 to form part of the affixing seating surface 26*c* for the development end sealing member 34. An inner diameter of the hole portion 60*b* is set to be smaller than the diameter of the shaft 33*a*, and as the hole portion 60*b* contacts the shaft 33*a* at a predetermined pressure, toner leakage along the shaft 33*a* of the toner supply roller 33 is suppressed. The diameter of the outer peripheral surface 60*a* of the bush member 60 is substantially identical to the diameter of the cylindrically formed engagement groove 26*d*.

A configuration for mounting the bush member 60 on the development frame member 26 will now be described. As illustrated in FIG. 7A, the shaft 33*a* of the toner supply roller 33 is inserted, from the upstream side to the downstream side in the mounting direction H, into the engagement groove 26*d* and the U-shaped groove 26*g* that are opened toward the affixing seating surface 26*c* for the development end sealing member 34.

After the toner supply roller 33 is mounted, as illustrated in FIGS. 5B and 7B, the bush member 60 is fitted into the engagement groove 26*d*. At this point, as the shaft 33*a* of the toner supply roller 33 fits in the hole portion 60*b* and the toner supply roller 33 is positioned by a bearing member 38, the position of the bush member 60 in a direction orthogonal to the axial direction of the developing roller 6 is set. Further, as the bush member 60 abuts against the inner wall surface 26*f* (see FIG. 7C), the position of the developing roller 6 in the axial direction thereof is set. Here, the shaft 33*a* of the toner supply roller 33 is exposed to the exterior of the development frame member 26 through the hole portion 60*b* of the bush member 60 and is in a state where the shaft 33*a* can be axially supported and can revive the drive force.

Then, as illustrated in FIG. 7C, the development end sealing member 34 is affixed to a seating surface that is formed by the exposure surface 60*a*1 of the outer peripheral surface 60*a* of the bush member 60 and the arc-shaped affixing seating surface 26*c*. Here, when the developing roller 6 is mounted, the development end sealing member 34 contacts the outer peripheral surface of the developing roller 6 at an axial end of the developing roller 6 with a predetermined pressure, and thus toner leakage along the end of the developing roller 6 is suppressed. The shaft 6*a* of the developing roller 6 projects externally in the axial direction thereof from a region where the developing roller 6 is in pressure contact with the development end sealing member 34 and is thus in a state where the shaft 6*a* can be axially supported and can receive the drive force.

Then, the developing roller 6 and the toner supply roller 33 are fixed to the development frame member 26 with the bearing member 38 serving as a positioning member for the developing roller 6 and the toner supply roller 33 rotatably supporting the shaft 6*a* of the developing roller 6 that is exposed to the outside of the development frame member 26 in the axial direction of the developing roller 6 and the shaft 33*a* of the toner supply roller 33. Further, as illustrated in FIG. 8, the bush member 60 is compressed in the axial direction of the developing roller 6 by the inner wall surface 26*f* of the development frame member 26 and a convex portion 38*a* of the bearing member 38. The bearing member 39 similarly includes a convex portion 39*a* (see FIG. 1). Accordingly, the bush member 60 is prevented from rotating in the direction of rotation of the toner supply roller 33 along with the rotation thereof (i.e., co-rotation).

The bush member 60 according to the present exemplary embodiment, when mounted on the development frame member 26, is in a state where part of the outer peripheral surface 60*a* (i.e., exposure surface 60*a*1) projects through the opening 26*d*1 of the engagement groove 26*d* and thus projects further toward the developing roller 6 than the affixing seating surface 26*c* (see FIG. 7B). The engagement groove 26*d* has a shape that becomes narrower gradually toward the affixing seating surface 26*c* for the development end sealing member 34, as described above. Portions 26*d*2 of the engagement groove 26*d* that define a gap narrower toward the upstream side in the toner supply roller mounting direction H serve to regulate the projection of the bush member 60 toward the affixing seating surface 26*c*. That is, even if the outer peripheral surface 60*a* of the bush member 60 expands by being compressed by the inner wall surface 26*f* of the development frame member 26 and the convex portion 38*a* of the bearing member 38 in the axial direction of the developing roller 6, the exposure surface 60*a*1 of the bush member 60 does not project excessively from the affixing seating surface 26*c*. Further, even if the bush member 60 is press-fitted in the engagement groove 26*d* due to a variation in size, the exposure surface 60*a*1 of the bush member 60 is prevented from projecting excessively from the affixing seating surface 26*c*. Accordingly, an influence that can be caused by the exposure surface 60*a*1 projecting excessively from the affixing seating surface 26*c* on a contact pressure of the development end sealing member 34 to the developing roller 6 can be suppressed, and good sealing performance can be obtained.

As illustrated in FIG. 9, the diameter j of the outer peripheral surface 60*a* of the bush member 60 can be set smaller than the diameter m of the cylindrically formed engagement groove 26*d* (i.e., diameter of the peripheral surface of the cylindrical portion of the engagement groove 26*d*). More specifically, as illustrated in FIG. 10A, the outer peripheral surface 60*a* of the bush member 60 is set to be smaller than a circle Q1 (i.e., diameter of the engagement groove 26*d*) that passes the ridgelines 26*c*1 and is coaxial with the bush member 60 but larger than a circle Q2 that passes the ridgelines 26*c*2 and is coaxial with the bush member 60. The bush member 60 is in tight contact with the inner wall surface 26*f* (see FIG. 7A), which suppresses toner leakage through an area V. Further, when the development end sealing member 34 (not illustrated in FIG. 10A) is affixed to the affixing seating surface 26*c*, the development end sealing member 34 adheres to the affixing seating surface 26*c* and the exposure surface 60*a*1 of the bush member 60 with no gap therebetween, which suppresses toner leakage through an area W. Setting the diameter of the outer peripheral surface 60*a* of the bush member 60 to be smaller than the circle Q1 but greater than the circle Q2 brings the area V into contact with the area W, which prevents forming a path for toner leakage.

Meanwhile, a case where the diameter of the outer peripheral surface 60*a* of the bush member 60 is set to be smaller than the circle Q2 that passes the ridgelines 26*c*2 and is coaxial with the bush member 60 will be described with reference to FIG. 10B. In this case, step portions 26*h* are formed in an affixing seating surface for the development end sealing member 34 that is formed by the affixing seating surface 26*c* and the exposure surface 60*a*1 of the bush member 60. Thus, the development end sealing member 34 cannot adhere to the affixing seating surface 26*c* and the exposure surface 60*a*1 of the outer peripheral surface 60 without any gap therebetween. That is, the area V is not in contact with the area W, which leads to formation of a path for toner leakage.

In this way, setting the diameter of the outer peripheral surface 60*a* of the bush member 60 to be smaller than the circle Q1 but greater than the circle Q2 can suppress toner leakage even if the outer diameter of the bush member 60 is set to be smaller than the diameter of the engagement groove 26*d*. Through this configuration, the bush member 60 can be mounted to the development frame member 26 in a state where the outer peripheral surface 60*a* is spaced apart from the cylindrical surface of the engagement groove 26*d* by a predetermined distance. Accordingly, the bush member 60 is prevented from interfering with the engagement groove 26*d* when being mounted, which can enhance the ease of assembly.

Here, the dimensional relationship described above is merely illustrative, and the exemplary embodiments are not limited to the above configurations. In other words, formation of a path for toner leakage can be suppressed as long as the width of the exposure surface 60*a*1 of the bush member 60 along the affixing seating surface 26*c* is greater than the width of an opening (second opening) of the U-shaped groove 26*g* but smaller than the width of the opening 26*d*1 of the engagement groove 26*d*.

Furthermore, forming the engagement groove 26*d* to become gradually narrower toward the affixing seating surface 26*c* makes it possible to secure a wider affixing seating surface 26*c* for the development end sealing member 34. Accordingly, the development end sealing member 34 can be prevented from peeling off due to the elasticity of the bush member 60, and thus good sealing performance can be obtained.

As described thus far, the developing device 9 according to the first exemplary embodiment has the following configuration. The engagement groove 26*d*, with which the bush member 60 engages and is fixed, has a shape where an engagement region thereof with the bush member 60 is opened at the affixing seating surface 26*c*. Thus, an end of the toner supply roller 33 can pass through the affixing seating surface 26*c* when the toner supply roller 33 is mounted on the development frame member 26. Further, the exposure surface 60*a*1 of the bush member 60 that is exposed from the affixing seating surface 26 through an opening between engagement regions forms part of a seating surface for the development end sealing member 34. In such a configuration, the engagement groove 26*d* is formed such that the engagement regions thereof define a gap that becomes narrower toward the opening at least in the vicinity of the opening in the first exemplary embodiment. Thus, toner leakage along an end of the developing roller 6 or a shaft portion of the toner supply roller 33 can be suppressed reliably using an inexpensive bush member.

In addition, the cylindrically shaped bush member (i.e., forming the bush member 60 to have a circular cross-section) makes is unnecessary to take into consideration a phase in the direction of rotation of the bush member 60 about the shaft 33*a* of the toner supply roller 33 during assembly, which can provide a sealing configuration that is easy to assemble. As the bush member 60 has an outer diameter that is smaller than the diameter of the engagement groove 26*d*, the bush member 60 can be mounted on the engagement groove 26*d* of the development frame member 26 with a predetermined gap secured therebetween, which further enhances the ease of assembly.

Although the present exemplary embodiment illustrates a case where the sealing configuration and the mounting configuration of the developing roller and the toner supply roller are identical at the drive side and the non-drive side, the configurations described above may be applied to only one of the drive side and the non-drive side. In addition, although the present invention is applied to the developing device in the above description, the present invention can also be applied to a process cartridge that includes the configuration of the developing device.

Figure 11A:
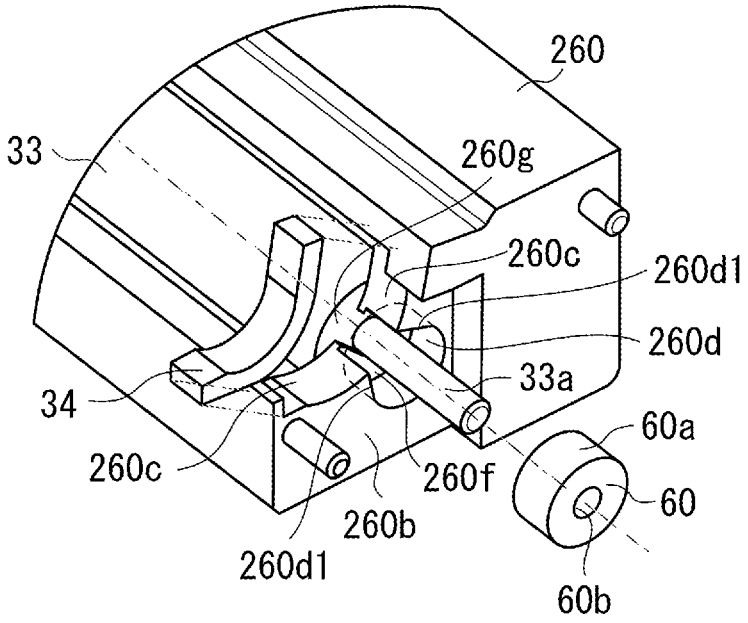
FIGS. 11A and 11B are exploded perspective views each illustrating a main section of a developing device according to a second exemplary embodiment.
Figure 11B:
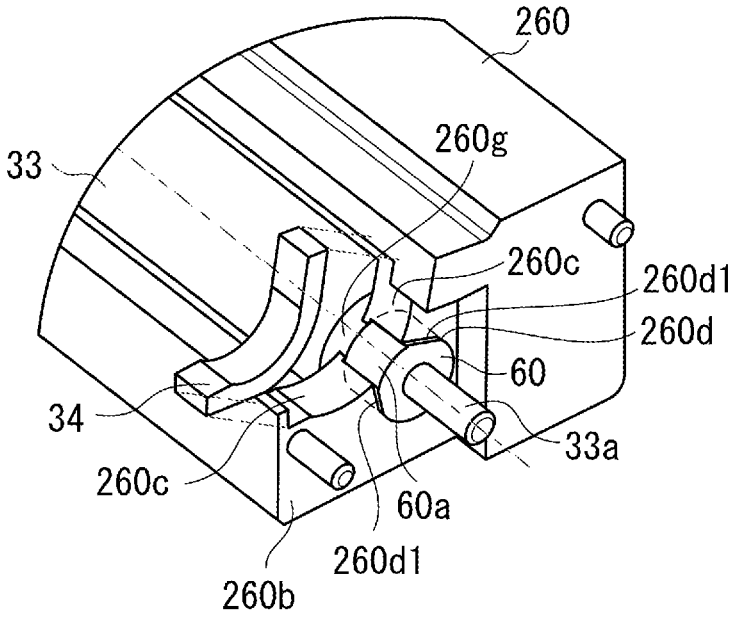
Figure 12:
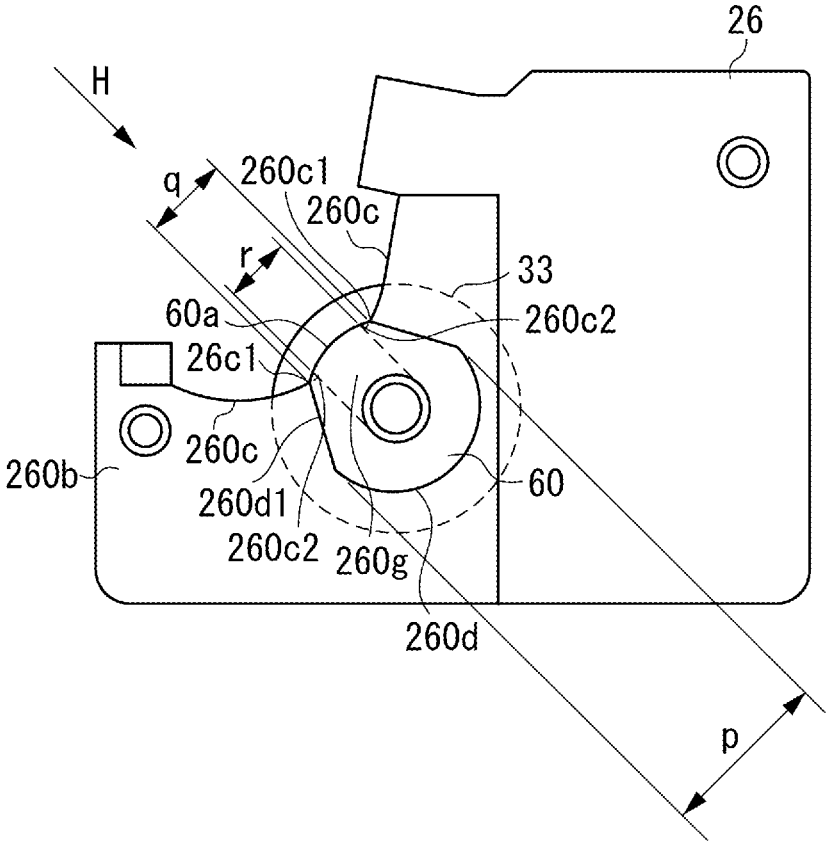
FIG. 12 is a side view illustrating the main section of the developing device according to the second exemplary embodiment.

A developing device according to a second exemplary embodiment of the present invention will now be described with reference to FIGS. 11A, 11B, and 12. FIGS. 11A and 11B are exploded perspective views each illustrating a main portion of the developing device according to the second exemplary embodiment of the present invention. FIG. 11A illustrates a state before the bush member 60 is mounted, and FIG. 11B illustrates a state after the bush member 60 is mounted. FIG. 12 is a side view illustrating the main portion of the developing device according to the second exemplary embodiment of the present invention. Note that configurations and operations that differ from those of the first exemplary embodiment will be described below, and components that have similar configurations and functions to those of the first exemplary embodiment are given identical reference characters, and the descriptions given in the preceding exemplary embodiment are incorporated hereinafter. Items that are not described in particular hereinafter are assumed to be identical to those of the first exemplary embodiment described above.

In the first exemplary embodiment described above, the engagement groove 26*d* for fixing the bush member 60 has arc shaped portions, and the distance between the arc shaped portions becomes smaller toward the affixing seating surface 26*c* for the development end sealing member 34. The shape of an engagement groove, however, is not limited to the one described above and can take on various forms.

As illustrated in FIG. 11A, in the present exemplary embodiment, a development frame member 260 includes an engagement groove 260*d* that is formed in a wall portion 260*b* located at a drive-side end in the axial direction of the developing roller 6. This engagement groove 260*d* includes planar surfaces 260*d*1 located in a region near an affixing seating surface 260*c*. These planar surfaces 260*d*1 define a portion that gradually becomes narrower toward the affixing seating surface 260*c* for the development end sealing member 34. More specifically, as illustrated in FIG. 12, the width of the engagement groove 260*d* as viewed in the toner supply roller mounting direction H takes on a maximum width p along a plane that contains a center portion of the engagement groove 260*d* and is orthogonal to the mounting direction H. Then, the width of the engagement groove 260*d* gradually decreases from the maximum width p from the downstream side toward the upstream side in the toner supply roller mounting direction H as the planar surfaces 260*d*1 are inclined toward each other, and the width of the engagement groove 260*d* takes a minimum width q at a gap defined by ridgelines 260*c*1 intersecting the affixing seating surface 260*c*.

In addition, an inner wall surface 260*f* is formed on the engagement groove 260*d* of the development frame member 260 at an inner side thereof in the axial direction of the developing roller 6, and the bush member 60 abuts against the inner wall surface 260*f* in the axial direction of the developing roller 6 when the bush member 60 is mounted on the development frame member 260. A U-shaped groove 260*g* that is opened toward the affixing seating surface 260*c* for the development end sealing member 34 is formed in the inner wall surface 260*f*. The width r of a gap defined by ridgelines 260*c*2 formed by the affixing seating surface 260*c* for the development end sealing member 34 and the U-shaped groove 260*g* is set to be greater than the diameter of the shaft 33*a* of the toner supply roller 33 so that the shaft 33*a* can be inserted thereinto.

Then, as illustrated in FIG. 11B, when the bush member 60 is mounted on the engagement groove 260*d*, the planar surfaces 260*d*1 that define a gap that becomes narrower toward the upstream side in the toner supply roller mounting direction H regulate the projection of the outer peripheral surface 60*a* from the affixing seating surface 260*c*. That is, in the present exemplary embodiment as well, the bush member 60 can be prevented from projecting excessively from the affixing seating surface 260*c*. The present exemplary embodiment is suitably applied, for example, in a case where the bush member 60 is compressed in the axial direction of the developing roller 6 by the inner wall surface 260*f* of the development frame member 260 and the convex portion 38*a* of the bearing member 38 and thus the outer peripheral surface 60*a* of the bush member 60 expands. In addition, the present exemplary embodiment is suitably applied in a case where the bush member 60 is press-fitted in the engagement groove 260*d* due to a variation in size. Accordingly, the present exemplary embodiment yields similar effects to those of the first exemplary embodiment.

Figure 13A:
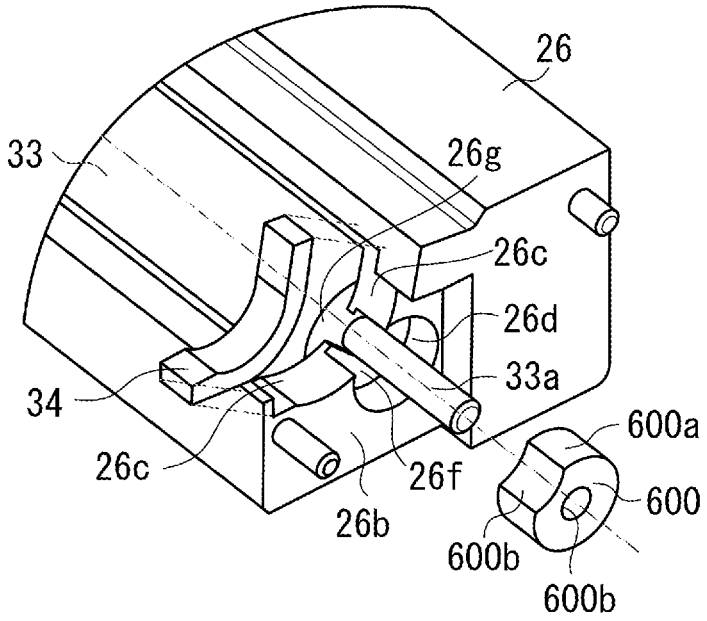
FIGS. 13A and 13B are exploded perspective views each illustrating a main section of a developing device according to a third exemplary embodiment.
Figure 13B:
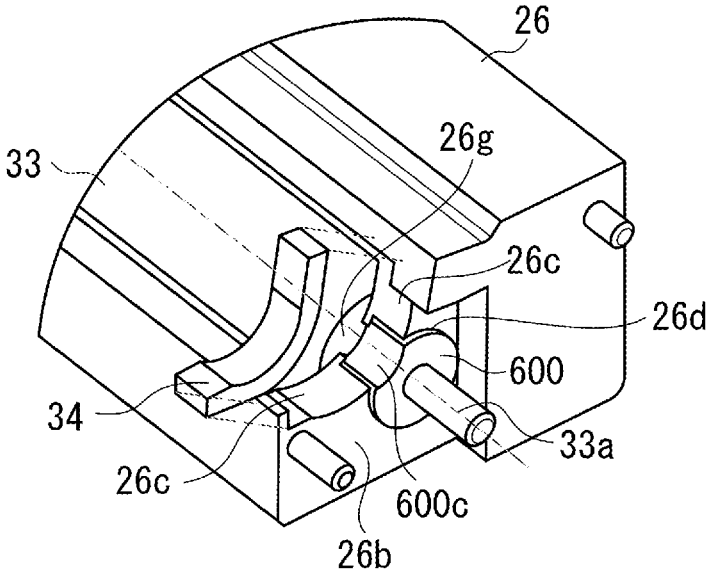

A developing device according to a third exemplary embodiment of the present invention will now be described with reference to FIGS. 13A and 13B. FIGS. 13A and 13B are exploded perspective views each illustrating a main portion of the developing device according to the third exemplary embodiment of the present invention. FIG. 13A illustrates a state before a bush member 600 is mounted, and FIG. 13B illustrates a state after the bush member 600 is mounted. Herein, configurations and operations that differ from those of the first and second exemplary embodiments will be described below, and components that have similar configurations and functions to those of the first and second exemplary embodiments are given identical reference characters, and the descriptions given in the preceding exemplary embodiments are incorporated hereinafter. Items that are not described in particular hereinafter are assumed to be identical to those of the first and second exemplary embodiment described above.

The cylindrically shaped bush member is used in the first and second exemplary embodiments. In the present exemplary embodiment, however, a portion of the bush member that is to be exposed through an opening in the affixing seating surface for the development end sealing member has a shape that follows along the shape of the affixing seating surface.

As illustrated in FIG. 13A, the bush member 600 according to the present exemplary embodiment includes an outer peripheral portion 600*a*, which is to engage with the engagement groove 26*d*, and a hole portion 600*b*, into which the shaft 33*a* of the toner supply roller 33 is to be inserted, and an arc portion 600*c* is formed in the outer peripheral portion 600*a*. More specifically, as illustrated in FIG. 13B, when the bush member 600 is mounted on the engagement groove 26*b*, the arc portion 600*c* has a curvature that is substantially the same as that of the affixing seating surface 26*c* for the development end sealing member 34 and projects from the affixing seating surface 26*c*.

Then, when the bush member 600 is mounted on the engagement groove 26*b*, similar effects to those of the first exemplary embodiment can be obtained, and in addition, a projection amount of the bush member 600 can be reduced. In other words, arc-shaped portions of the engagement groove 26*d* that define a gap that gradually becomes narrower regulate the projection of the outer peripheral portion 600*a* from the affixing seating surface 26*c*, similarly to the first exemplary embodiment. In addition, in the present exemplary embodiment, since the bush member 600 includes the arc portion 600*c* that is to project from the affixing seating surface 26*c*, a projection amount of the bush member 600 from the affixing seating surface 26*c* can be reduced. In other words, an influence on a contact pressure of the development end sealing member 34 to the developing roller 6 can be further suppressed, and thus good sealing performance can be obtained in the present exemplary embodiment as well.

As described above, according to the exemplary embodiments of the present invention, a developing device and a process cartridge that include a sealing configuration that suppresses toner leakage more reliably and that is simple and easy to assemble can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-201853, filed Sep. 13, 2012, which is hereby incorporated by reference herein in its entirety.

What is claimed is:

1. A developing device to be used in an image forming apparatus, the developing device comprising:

a frame member;

a developing roller configured to develop a latent image formed on an image bearing member using developer;

a developer supply roller configured to supply the developer to the developing roller;

an end sealing member configured to prevent a leakage of the developer through a gap between the frame member and an end of the developing roller in a longitudinal direction thereof;

a bush member having elasticity, the bush member being configured to prevent a leakage of the developer from gap between the frame member and an end of the developer supply roller in a longitudinal direction thereof;

a first groove configured to fix the bush member; and an abutment portion configured to regulate movement of the bush member in the longitudinal direction, wherein the frame member includes a second groove formed in a wall portion that includes the abutment portion so as to be adjacent to the first groove in the longitudinal direction, and the second groove is configured to engage with the end of the developer supply roller.

2. The developing device according to claim 1, wherein the first groove includes engagement regions configured to regulate movement of the bush member in the direction intersecting the longitudinal direction, the engagement regions being arranged to approach each other toward an opening which is exposed from the seating surface.

3. The developing device according to claim 2, wherein a portion of the bush member that is exposed through the opening contacts the end sealing member.

4. The developing device according to claim 1, wherein the bush member has a foamable property.

5. The developing device according to claim 1, wherein an outer peripheral surface of the bush member has a circular cross-section, and an inner wall surface of the first groove has a circular cross-section.

6. The developing device according to claim 5, wherein a diameter of the outer peripheral surface of the bush member is smaller than a diameter of the inner wall surface of the first groove.

7. The developing device according to claim 1, wherein a portion of the bush member that is exposed through an opening has a shape that follows along a shape of the seating surface.

8. The developing device according to claim 1, further comprising:

a bearing member configured to rotatably support the end of the developer supply roller, compress the bush member in the longitudinal direction by sandwiching the bush member between the abutment portion and the bearing member, and bias the bush member against an inner wall surface of the first groove.

9. A process cartridge that can be attached to an image forming apparatus, the process cartridge comprising:

an image bearing member;

a frame member;

a developing roller configured to develop a latent image formed on the image bearing member using developer;

a developer supply roller configured to supply the developer to the developing roller;

an end sealing member configured to prevent a leakage of the developer through a gap between the frame member and an end of the developing roller in a longitudinal direction thereof;

a bush member having elasticity, the bush member being configured to prevent a leakage of the developer from a gap between the frame member and an end of the developer supply roller in a longitudinal direction thereof;

a first groove configured to fix the bush member; and an abutment portion configured to regulate movement of the bush member in the longitudinal direction, wherein the frame member includes a second groove formed in a wall portion that includes the abutment portion so as to be adjacent to the first groove in the longitudinal direction, and the second groove is configured to engage with the end of the developer supply roller.

10. The process cartridge according to claim 9, wherein the first groove includes engagement regions configured to regulate movement of the bush member in the direction intersecting the longitudinal direction, the engagement regions being arranged to approach each other toward an the first opening which is exposed from the seating surface.

11. The process cartridge according to claim 10, wherein a portion of the bush member that is exposed through the first opening contacts the end sealing member.

12. The process cartridge according to claim 9, wherein the bush member has a foamable property.

13. The process cartridge according to claim 9, wherein an outer peripheral surface of the bush member has a circular cross-section, and an inner wall surface of the first groove has a circular cross-section.

14. The process cartridge according to claim 13, wherein a diameter of the outer peripheral surface of the bush member is smaller than a diameter of the inner wall surface of the first groove.

15. The process cartridge according to claim 10, wherein a portion of the bush member that is exposed through an opening has a shape that follows along a shape of the seating surface.

16. The process cartridge according to claim 9, further comprising:

a bearing member configured to rotatably support the end of the developer supply roller, compress the bush member in the longitudinal direction by sandwiching the bush member between the abutment portion and the bearing member, and bias the bush member against an inner wall surface of the first groove.

* * * * *